United States Patent [19]

Lane et al.

[11] Patent Number: 5,028,508

[45] Date of Patent: Jul. 2, 1991

[54] METAL SALTS OF BETA-DIKETONES AS CHARGING ADJUVANTS FOR ELECTROSTATIC LIQUID DEVELOPERS

[75] Inventors: Gregg A. Lane, Kennett Square; James R. Larson, West Chester; Ronald L. Mueller, Exton, all of Pa.

[73] Assignee: DXImaging, Lionville, Pa.

[21] Appl. No.: 453,834

[22] Filed: Dec. 20, 1989

[51] Int. Cl.[5] ..... G03G 9/135

[52] U.S. Cl. ..... 430/115; 430/137

[58] Field of Search ..... 430/110, 115, 137

[56] References Cited

U.S. PATENT DOCUMENTS 4,702,985 10/1987 Larson ..... 430/115

4,767,688 8/1988 Hashimoto et al. ..... 430/110

*Primary Examiner*—John Goodrow

[57] ABSTRACT

An electrostatic developer consisting essentially of (A) a nonpolar liquid having a Kauri-butanol value of less than 30, present in a major amount; (B) thermoplastic resin particles, less than 30 μm average particle size, a nonpolar liquid soluble ionic or zwitterionic charge director compound (C), and (D) a metal salt of a β-diketone as described. The process of preparation of the liquid electrostatic developer is also described. The liquid developers of the invention are useful in copying, color proofing, including digital color proofing, lithographic printing plates and resists.

58 Claims, No Drawings

METAL SALTS OF BETA-DIKETONES AS CHARGING ADJUVANTS FOR ELECTROSTATIC LIQUID DEVELOPERS

TECHNICAL FIELD

This invention relates to an electrostatic liquid developer. More particularly this invention relates to an electrostatic liquid developer containing resin particles and metal salts of $\beta$-diketones as charging adjuvants.

BACKGROUND OF THE INVENTION

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 30 $\mu$m average particle size as measured using the Malvern 3600E Particle Sizer described below. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, metal soaps, etc. to the liquid developer comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor transfer efficiency and poor solid area coverage. Solid area coverage is often reduced by crater-like defects (mottle) formed during image fusion. In order to overcome such problems much research effort has been expended to develop new type charge directors and/or charging adjuvant for electrostatic liquid toners.

It has been found that the above disadvantages can be overcome and improved developers prepared containing a dispersant nonpolar liquid, ionic or zwitterionic charge director compound, a thermoplastic resin, a colorant and an adjuvant compound described more fully below. Depending on the charge director used the developers containing these salts may be positive or negative. The improved electrostatic liquid developer when used to develop an electrostatic image results in improved image quality, transfer efficiency, and solid area coverage, and reduced mottle independent of the pigment and charge director present.

SUMMARY OF THE INVENTION

In accordance with this invention there is provided an electrostatic liquid developer consisting essentially of (A) a nonpolar liquid having a Kauri-butanol value of less then 30, present in a major amount, (B) thermoplastic resin particles having an average particle size of less than 30 $\mu$m, (C) a nonpolar liquid soluble ionic or zwitterionic charge director compound, and (D) a $\beta$-diketone compound of the general formula:

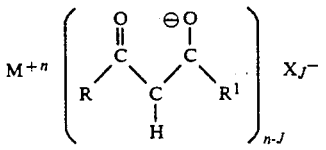

where M is a metal cation;

R and $R^1$ which can be the same or different are alkyl of 1 to 18 carbon atoms, substituted alkyl of 1 to 18 carbon atoms, aryl of 6 to 30 carbon atoms, or substituted aryl of 6 to 30 carbon atoms;

n is the valency of the metal;

J is 0 to n−1; and $X^-$ is OH, Cl, F, sulphate, nitrate, chlorate, phosphate, acetate, alkyl carboxylate of 1 to 18 carbon atoms, or aryl carboxylate of 6 to 30 carbon atoms.

In accordance with an embodiment of this invention there is provided a process for preparing electrostatic liquid developer for electrostatic imaging comprising (A) dispersing at an elevated temperature in a vessel a thermoplastic resin and a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 $\mu$m from the particulate media;

(D) adding to the dispersion a nonpolar liquid soluble ionic or zwitterionic charge director compound; and (E) adding during any of steps (A), (B), (C) or (D) a metal salt of the general formula:

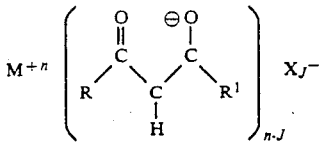

where M is a metal cation;

R and $R^1$ which can be the same or different are alkyl of 1 to 18 carbon atoms, substituted alkyl of 1 to 18 carbon atoms, aryl of 6 to 30 carbon atoms, or substituted aryl of 6 to 30 carbon atoms;

n is the valency of the metal;

J is 0 to n−1; and $X^-$ is OH, Cl, F, sulphate, nitrate, chlorate, phosphate, acetate, alkyl carboxylate of 1 to 18 carbon atoms, or aryl carboxylate of 6 to 30 carbon atoms.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as fine particle size oxides, adjuvant, e.g., polyhydroxy compound, aminoalcohol, polybutylene succinimide, aromatic hydrocarbon, etc.

Aminoalcohol means that there is both an amino functionality and hydroxyl functionality in one compound.

Conductivity is the conductivity of the developer measured in picomhos (pmho)/cm at 5 hertz and 5 volts.

Mottle is defined as a visible inhomogeneity in image reflection density, appearing as crater-like defects. This mottle is manifested during the fusing step and is aggravated by higher fusing temperatures and by high wetting of the paper by the hydrocarbon carrier, e.g., nonpolar liquid. The image defect is believed to be brought about by the escape of hydrocarbon vapor through a partially fused toner layer.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components, dispersed therein, e.g., pigment component, adjuvant, etc.

Useful thermoplastic resins or polymers (B) include: ethylene vinyl acetate (EVA) copolymers (Elvax® resins, E.I. du Pont de Nemours and Company, Wilmington, DE), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E.I. du Pont de Nemours and Company, Wilmington, DE, etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the resins have the following preferred characteristics:

1. Be able to disperse the adjuvant, colorant, e.g., pigment,
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 15 μm, in diameter,
5. Be able to form a particle of less than 30 μm, e.g., determined by Malvern 3600E Particle Sizer, manufactured by Malvern, Southborough, MA. The Malvern 3600E Particle Sizer uses laser diffraction light scattering of stirred samples to determine average particle sizes.
6. Be able to fuse at temperatures in excess of 70° C.

By solvation in 3. above, the resins forming the toner particles will become swollen or gelatinous.

Suitable nonpolar liquid soluble ionic or zwitterionic charge director compounds (C), which are generally used in an amount of 0.25 to 1500 mg/g, preferably 2.5 to 400 mg/g developer solids, include: negative charge directors, e.g., lecithin, Basic Calcium Petronate®, Basic Barium Petronate® oil-soluble petroleum sulfonate, manufactured by Sonneborn Division of Witco Chemical Corp., New York, NY, alkyl succinimide (manufactured by Chevron Chemical Company of California), positive charge directors, e.g., anionic glycerides such as Emphos® D70-30C, Emphos® F27-85, etc., sodium salts of mono- and diglycerides with saturated and unsaturated acid substituents, manufactured by Witco Chemical Corp., New York, NY, etc.

The β-diketone compounds (D) of the invention have the general formula:

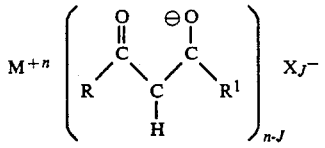

where

M is a metal cation such as $Al^{+3}$, $Ca^{+2}$, $Ni^{+2}$, $Cr^{+3}$, $Mg^{+2}$, etc.;

R and $R^1$ which can be the same or different are alkyl of 1 to 18 carbon atoms, substituted alkyl of 1 to 18 carbon atoms which is substituted with alkyl of 1 to 10 carbon atoms, alkoxy of 1 to 10 carbon atoms, halogen such as chloride, bromide, etc.; amino, and other substituents known to those of ordinary skill in the art, aryl of 6 to 30 carbon atoms, substituted aryl of 6 to 30 carbon atoms substituted with alkyl of 1 to 10 carbon atoms, alkoxy of 1 to 10 carbon atoms, halogen such as chloride, bromide, etc.; amino, hydroxyl, nitro, and others known to those of ordinary skill in the art;

n is the valency of the metal;

J is O to n−1; and $X^-$ is OH, Cl, F, sulphate, nitrate, chlorate, phosphate, acetate, alkyl carboxylate of 1 to 18 carbon atoms, aryl carboxylate of 6 to 30 carbon atoms.

The metal salt is present in 0.1 to 40 percent by weight of developer solids, preferably 1 to 10 percent by weight based on the total weight of the developer solids. The metal salts of β-diketones may be added at any stage in the preparation of the liquid developers. Preferably, they are added during the hot dispersion step. The method whereby the β-diketone is dispersed in the thermoplastic resin is described below.

Suitable metal salts of β-diketones include: calcium acetylacetonate, aluminum acetylacetonate, aluminum octadecanoylacetonate, aluminum benzoylacetonate, calcium octadecanoylacetonate, calcium benzoylacetonate, nickel acetylacetonate, chromium acetylacetonate, aluminum diacetylacetonate hydroxide, calcium acetylacetonate hydroxide, aluminum diacetylacetonate chloride, aluminum octanoylacetonate, calcium octanoylacetonate, aluminum dodecanoylacetonate, calcium dodecanoylacetonate, nickel benzoylacetonate, chromium benzoylacetonate, aluminum p-methoxybenzoylacetonate, aluminum trifluoroacetylacetonate, aluminum hexafluoroacetylacetonate, magnesium acetylacetonate, etc.

As indicated above, colorants, when present in the developer, are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

| Pigment Brand Name | Manufacturer | Pigment Colour Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue D 7072 DD | BASF | P. B. 15:3 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Heucophthal Blue G XBT 583D | Heubach | |
| Paliogen ® Blue L 6470 | BASF | Blue 60 |
| Heliogen ® Green K 8683 | BASF | Green 7 |
| Heliogen ® Green L 9140 | BASF | Green 36 |
| Eupolen ® Blue 70-8001 | BASF | P. B. 15:3 |
| Monastral ® Violet R | Ciba-Geigy | Violet 19 |

-continued

| Pigment Brand Name | Manufacturer | Pigment Colour Index |
|---|---|---|
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

Other ingredients may be added to the electrostatic liquid developer, such as fine particle size inorganic oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be taken from the group of polyhydroxy compound which contains at least 2 hydroxy groups, aminoalcohol, polybutylene succinimide, and aromatic hydrocarbon having a Kauri butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. No. 4,707,429 and U.S. Pat. No. 4,740,444.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkylsubstituted benzenes manufactured by Exxon Corp., etc. as described in Mitchell U.S. Pat. No. 4,631,244.

The particles in the electrostatic liquid developer have an average particle size of less than 30 μm as measured by Malvern 3600E Particle Sizer described below, preferably the average by area particle size is less than 15 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one of thermoplastic resin and nonpolar liquid described above. Generally the resin, colorant, metal salt of β-diketones, and nonpolar liquid are placed in the vessel prior to starting the dispersing step. Optionally the colorant and the metal salt of β-diketone can be added after homogenizing the resin and the dispersant nonpolar liquid. Polar additive, e.g., those disclosed in Mitchell U.S. Pat. No. 4,631,244, the disclosure of which is incorporated herein by reference, can also be present in the vessel, e.g., up to 100% based on the weight of the nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with or without the presence of additional liquid with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size of less than 30 μm, as determined by a Malvern 3600E Particle Sizer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is normally conducted to reduce the concentration of toner particles to between 0.1 to 15 percent by weight, preferably 0.3 to 4.0, and more preferably 1 to 3 weight percent with respect to the nonpolar liquid. One or more nonpolar liquid soluble charge director compounds (C), of the type set out above, can be added to impart a positive or negative charge, as desired. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with, or subsequent thereto. If the metal salt of β-diketone and adjuvant compound of a type described above have not been previously added in the preparation of the developer, they can be added prior to or subsequent to the developer being charged. Preferably the adjuvant compound is added before or is present during the dispersing step.

Other process embodiments for preparing the electrostatic liquid developer include:

(A) dispersing a colorant in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, (E) adding additional nonpolar liquid, polar liquid or combinations thereof to reduce the concentration of toner particles to between 0.1 to 15.0 percent by weight with respect to the liquid, (F) adding to the dispersion a liquid soluble charge director compound, and (G) adding during any of steps (A), (B), (C), (D), (E) or (F) a metal salt of a β-diketone as described above; and (A) dispersing a colorant in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media;

(F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound, and (H) adding during any of steps (A), (B), (C), (D), (E), (F) or (G) a metal salt of a β-diketone as described above.

INDUSTRIAL APPLICABILITY

The electrostatic liquid developers of this invention demonstrate improved image quality, resolution, solid area coverage, and toning of fine details, evenness of toning, reduced squash, and less mottle independent of charge director and pigment present. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes were determined by a Malvern 3600E Particle Sizer, manufactured by Malvern, Southborough, MA as described above, the conductivity was measured in picomhos (pmho)/cm at 5 hertz and low voltage, 5 volts, and the density was measured using a Macbeth densitometer model RD918. The resolution is expressed in the examples in line pairs/mm (lp/mm). The high frequency mobility of the toner particles in the liquid developer was measured using an electrokinetic sonic analysis instrument, Matec, Inc., Hopkinton, MA. The instrument determines this mobility in $m^2/V sec X10^{-10}$ where V is volts. Weight average molecular weight can be determined by gel permeation chromatography (GPC). Rough paper is Xerox 4024 paper, and smooth paper is Plainwell offset enamel paper, No. 3 gloss, 60 lbs test, Plainwell Paper Co., Plainwell, MO.

CONTROL 1

A cyan developer was prepared by adding 256.8 g of a copolymer of ethylene (90%) and methacrylic acid (10%), melt index at 190° C. is 500, acid no. is 60, 64.2 grams of Heliogen® Blue NBD 7010 cyan pigment (BASF), and 1284 grams of Isopar®-L (Exxon) to a Union Process 1S Attritor, Union Process Company, Akron, OH charged with 0.1875 inch (4.76 mm) diameter carbon steel balls. The mixture was milled at 100° C. for 1 hour then cooled to ambient temperature and the mixture was milled for 4 hours. The average particle size was 6.5 μm. The developer was diluted and charged as follows: 1500 grams of 1.5% solids toner was charged with 7.5 grams of 10% Basic Barium Petronate® oil-soluble petroleum sulfonate, Witco Chem. Corp., NY, NY (BBP). Image Quality was determined using a Savin 870 copier at standard mode: charging corona set at +6.8 Kv, development bias set at +50 volts, and transfer corona set at +6.6 Kv, normal image target (black areas on target image with negative developer, white areas on target do not image with negative developer.) Developer gave an image expected for a negative developer.

EXAMPLE 1

A toner was prepared as described in Control 1 except that 2.25 grams of calcium acetylacetonate (Ca(acac)3) (Strem Chemicals, Newburyport, MA) were dispersed in the resin during hot processing. Results of imaging studies are shown in Table 1 below.

TABLE 1

| Control or Example | Adjuvant | Paper | Density | Resolution (lp/mm) | Mobility ($m^2$/Vsec) $\times 10^{-10}$) |
|---|---|---|---|---|---|
| C1 | none | rough | 0.59 | 3 | −1.4 |
| | | smooth | 0.40 | 3 | |
| E1 | $Ca(acac)_3$ | rough | 1.06 | 7 | −10.4 |
| | | smooth | 1.28 | 8 | |

EXAMPLE 2

To 30 grams of a developer identical in composition to that in Control 1 above was added 0.15 gram of aluminum octadecanoylacetonate, $Al(CH_3(CH_2)_{17}COCHCOCH_3)_3$, ($Al(oda)_3$), synthesized by the following method:

Acetone and sodium amide were reacted in ether to produce the enolate salt. To this solution was added an ether solution of methyl stearate giving octadecanoyl acetone at 70% yield which was characterized by IR and NMR. The aluminum salt was then obtained by reaction of a methanol solution of octadecanoyl acetone with an aqueous solution of potassium alum.

After sonication, 0.15 gram of the charge director described in Control 1 was added. Mobility data, given in Table 2 below can be correlated to imaging performance, density and resolution, as shown in Table 1.

TABLE 2

| Control or Example | Adjuvant | Mobility ($m^2$/Vsec $\times 10^{-10}$) |
|---|---|---|
| C1 | none | −1.7 |

TABLE 2-continued

| Control or Example | Adjuvant | Mobility ($m^2$/Vsec $\times 10^{-10}$) |
|---|---|---|
| E1 | $Al(oda)_3$ | −13.1 |

CONTROL 2

An unpigmented toner was prepared by adding 45 g of a copolymer of ethylene (90%) and methacrylic acid (10%), melt index at 190° C. is 500, acid no. is 60, and 135 grams of Isopar®-L to a Union Process 01 Attritor, Union Process Company, Akron, OH charged with 0.1875 inch (4.76 mm) diameter carbon steel balls. The mixture was milled at 100° C. for 1 hour then cooled to ambient temperature and the mixture was milled for 4 hours. The particle size was 7.2 μm. The toner was diluted and charged as follows: 1500 grams of 1.5% solids toner was charged with 7.5 g of 10% Basic Barium Petronate® described in Control 1 or Emphos® D70-30C, sodium salt of phosphated mono- and diglycerides, Witco Chem. Corp., NY, NY (Emphos®).

EXAMPLE 3

A developer was prepared as described in Control 2 except that 2.25 grams of aluminum benzoylacetonate, ($Al(bza)_3$), (Strem Chemicals, Newburyport, MA) was dispersed in the resin during processing. Mobility data given in Table 3 below can be correlated to imaging performance, density and resolution, as shown in Table 1.

TABLE 3

| Control or Example | Charge Director | Mobility ($m^2$/Vsec $\times 10^{-10}$) |
|---|---|---|
| C2 | BBP | −2.6 |
| | Emphos® | −2.7 |
| E3 | BBP | −14.1 |
| | Emphos® | −14.5 |

CONTROL 3

A cyan developer was prepared by adding 29.7 g of a copolymer of ethylene (90%) and methacrylic acid (10%), melt index at 190° C. is 500, acid no. is 60, 3.3 g of Heucophthal Blue G XBT 583D pigment, Heubach, Inc., Newark, NJ, and 135 grams of Isopar®-L to a Union Process 01 Attritor, Union Process Company, Akron, OH charged with 0.1875 inch (4.76 mm) diameter carbon steel balls. The mixture was milled at 100° C. for 1 hour then cooled to ambient temperature and the mixture was milled for 2 hours. The particle size was 5.9 μm. The developer was diluted and charged as follows: 1500 grams of 1.0% solids was charged with 7.5 grams of 10% Basic Barium Petronate® described in Control 1. Image quality was determined using a Savin 870 copier at standard mode: charging corona set at +6.8 Kv, development bias set at +50 volts, and transfer corona set at +6.6 Kv, normal image target (black areas on target image with negative toner, white areas on target do not image with negative toner). Toner gave an image on smooth paper expected for a negative toner. Results are shown in Table 4 below.

EXAMPLE 4

Developers were prepared, charged to the same level, and tested as described in Control 3 except 0.82 g Ni acetylacetonate (97%) ($Ni(acac)_2$) (Aldrich) was dispersed in the resin with the pigment. Image quality was determined using Savin 870 under positive toner test conditions: charging corona set at +6.8 Kv, development bias set at +650 volts, and transfer corona set at −6.6 Kv, reversal image target (black areas on target image with negative toner, white areas on target image with positive toner, gray areas are background). The paper used was the same as described in Control 3. Results are shown in Table 4 below.

TABLE 4

| CONTROL OR EXAMPLE | ADJUVANT | COND. (pmho/cm) | TONER CHARGE | DENSITY | RESOLUTION (lp/mm) |
|---|---|---|---|---|---|
| C3 | NONE | 25 | NEG | 0.55 | 3 |
| E4 | $Ni(acac)_2$ | 17 | NEG | 0.60 | 8 |

CONTROL 4

A developer was prepared as described in Control 1 with the following exceptions: the developer was diluted to 1% solids, and to 1150 g of the diluted developer were added 9.6 g 10% Emphos® as described in Control 2. Image quality was determined using Savin 870 under positive toner test conditions: charging corona set at +6.8 Kv, development bias set at +650 volts, and transfer corona set at −6.6 Kv, reversal image target (black areas on target image with negative toner, white areas on target image with positive toner, gray areas are background.) The paper used was as described in Control 3. Results are shown in Table 5 below.

EXAMPLE 5

Developers were prepared, charged to the same level, and tested as described in Control 4 with the following exception: 0.82 g Ni acetylacetonate ($Ni(acac)_2$) (97% Aldrich) was dispersed in the resin with the pigment. The paper used was as described in Control 3. Results are shown in Table 5 below.

TABLE 5

| CONTROL OR EXAMPLE | ADJUVANT | COND. (pmho/cm) | TONER CHARGE | DENSITY | RESOLUTION (lp/mm) |
|---|---|---|---|---|---|
| C4 | NONE | 8 | — | — | — |
| E5 | $Ni(acac)_2$ | 5 | POS | 0.30 | 8 |

CONTROL 5

A cyan developer was prepared by adding 300 grams of a copolymer of ethylene (90%) and methacrylic acid (10%), melt index at 190° C. is 500, acid no. is 60, 32 grams of Heucophthal Blue G XBT 583D pigment, Heubach, Inc., Newark, NJ, and 776 grams of Isopar®-L to a Union Process 1S Attritor, Union Process Company, Akron, OH charged with 0.1875 inch (4.76 mm) diameter carbon steel balls. The mixture was milled at a 100° C. for 1 hour, then cooled to ambient temperature and milling was continued for 2 hours. The particle size was 9.0 μm. The developer was diluted and charged as follows: 1500 grams of 1.0% solids were charged with 7.5 grams of 10% Basic Barium Petronate® as described in Control 1. Image quality was determined using a Savin 870 copier at standard mode: charging corona set at 6.8 Kv and transfer corona set at 8.0 Kv. The results are shown in Table 6 below.

EXAMPLE 6

The developer concentrate from Control 5 was diluted and charged identically to Control 2 with the following exception: Cr(Acetoacetonate) ($Cr(acac)_3$) (Aldrich) was added in the following amounts: Sample (A) 0.05 gram; Sample (B) 0.50 gram; Sample (C) 5.0 grams. Image quality was determined using a Savin 870 copier at standard mode: charging corona set at 6.8 Kv and transfer corona set at 8.0 Kv. Results are set out in Table 6 below. The uniformity of solid areas on the Offset paper described in Control 3 was much improved for the Samples (A), (B), and (C) than for the developer of Control 2. Transfer efficiency did not distinguish Control 2 from the samples of this example.

TABLE 6

| CONTROL OR EXAMPLE | $Cr(acac)_3$ ADJUVANT (grams) | COND. (pmho/cm) | DENSITY | RESOLUTION (lp/mm) |
|---|---|---|---|---|
| C5 | None | 15 | 2.05 | 6 |
| E6(A) | 0.05 | 17 | 2.15 | 9 |
| E6(B) | 0.50 | 18 | 2.12 | 9 |
| E6(C) | 5.0 | 17 | 2.11 | 8 |

Image Quality Test

Image quality was evaluated on a testbed using a photopolymer master similar to that disclosed in Riesenfeld et al., U.S. Pat. No. 4,732,831. The photopolymer master was exposed imagewise with an ultraviolet source through a silver halide film bearing an image pattern. This rendered the exposed areas resistive, while the unexposed areas remained conductive. The photopolymer master was then mounted on a steel drum, and the conductive backing of the film was grounded to the drum. The drum rotated at 2.2 inches/second (5.59 cm/second). The photopolymer master was charged to a surface voltage of +200 +/−30 V with a scorotron, and the charge decayed to background levels in the conductive areas, thus forming a latent electrostatic image. This latent electrostatic image was developed 3.6 seconds after charging using a pair of grounded roller toning electrodes gapped 0.01 inch (0.0254 cm) from the surface of the photopolymerizable layer and rotated at 3.9 inches/second (9.906 cm/second) in the direction of the drum rotation, through which the liquid developer was delivered. The developed image was metered with a 1.5 in. (3.81 cm) diameter steel roller gapped 0.004 inch (0.0102 cm) from the photopolymerizable layer, rotated at 4.7 inches/second (11.938 cm/second) in the opposite direction of the drum rotation and biased to +150 +/−20 V. The developed image was then transferred to Isopar ®-L pre-wetted Textweb paper (Champion Papers, Inc., Stamford, CT) at 2.2 inches/second (5.588 cm/second) through a transfer zone defined at the lead edge by a biased conductive rubber roller and at the trailing edge by a corotron. The roller was set at −3.5 kV, the corotron wire current was set at 30±20 microamps, and the corotron housing was grounded. The paper receiver was tacked to the surface of the photopolymerizable layer by the biased conductive rubber roller, and the motion of the drum pulled the paper through the transfer zone. The final transferred image was fused in an oven at 400°-450° F. (204.4°-232.2° C.) for approximately 45 seconds.

CONTROL 6

A cyan developer was prepared by adding 297.5 g of a copolymer of ethylene (90%) and methacrylic acid (10%; melt index at 190° C. is 500, acid no. is 60), 45.5 g of Heliogen ® Blue NBD 7010 pigment (BASF Corporation, Parsippany, NJ), 7.0 g of aluminum distearate (Witco Chemical Corporation, Houston, TX), and 946.0 g of Isopar ®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour and then 454.0 g of Isopar ®-L were added. The mixture was cooled and milled for 1 hour at ambient temperature. Again 583.0 g of Isopar ®-L were added and the mixture was milled for 3 more hours. The particle size was 8.75 μm. The developer was diluted and charged as follows: 2500 g of 1.5% solids was charged with 18.75 g of 10% Basic Barium Petronate ® described in Control 1. Image quality was determined as described above. Results are shown in Table 7 below.

EXAMPLE 7

A cyan developer was prepared by adding 223.7 g of a copolymer of ethylene (90%) and methacrylic acid (10%; melt index at 190° C. is 500, acid no. is 60), 74.6 g of Pliotone ® 3015 (Goodyear, Akron, OH), 48.3 g of Heliogen ® Blue D 7072 DD pigment (BASF Corporation, Parsippany, NJ), 3.5 g of aluminum acetylacetonate (Pfaltz and Bauer, Newburyport, CT), and 946.0 g of Isopar ®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour then 454.0 g of Isopar ®-L were added. The mixture was cooled and milled for 1 hour at ambient temperature. Again 583.0 g of Isopar ®-L were added and the mixture was milled for 3 more hours. The particle size was 7.4 μm. The developer was diluted and charged as described in Control 6. Image quality was determined as described above. Results are shown in Table 7 below.

EXAMPLE 8

A cyan developer was prepared by adding 263.4 g of a copolymer of ethylene (90%) and methacrylic acid (10%; melt index at 190° C. is 500, acid no. is 60), 37.6 g of Pliotone ® 4010 (Goodyear, Akron, OH), 45.5 g of Heliogen ® Blue NBD 7010 pigment (BASF Corporation, Parsippany, NJ), 3.5 g of aluminum acetylacetonate (Pfaltz and Bauer. Newburyport, CT), and 946.0 g of Isopar ®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour then 454.0 g of Isopar ®-L were added. The mixture was cooled and milled for 1 hour at ambient temperature. Again 583.0 g of Isopar ®-L were added and the mixture was milled for 3 more hours. The particle size was 7.25 μm. The developer was diluted and charged as described in Control 6. Image quality was determined as described above. Results are shown in Table 7 below.

EXAMPLE 9

A cyan developer was prepared by adding 270.6 g of a copolymer of ethylene (90%) and methacrylic acid (10%; melt index at 190° C. is 500, acid no. is 60), 76.0 g of Eupolen ® Blue 70-8001 pigment (BASF Corporation, Parsippany, NJ), 3.5 g of aluminum acetylacetonate (Pfaltz and Bauer, Newburyport, CT), and 946.0 g of Isopar ®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour then 454.0 g of Isopar ®-L were added. The mixture was cooled and milled for 1 hour at ambient temperature. Again 583.0 grams of Isopar ®-L were added and the mixture was milled for 3 more hours. The particle size was 7.45 μm. The developer was diluted and charged as described in Control 6. Image quality was determined as described above. Results are shown in Table 7 below.

EXAMPLE 10

The developer concentrate from Control 6 was diluted and charged identically to Control 6 except that 0.38 g of aluminum acetylacetonate was added to it. Image quality was determined as described above. Results are shown in Table 7 below.

TABLE 7

| Control or Example | Density | Mottle Rating |
|---|---|---|
| C6 | 1.27 | Very Poor |
| E7 | 1.27 | Good |
| E8 | 1.27 | Fair |
| E9 | 1.27 | Excellent |
| E10 | 1.28 | Very Good |

CONTROL 7

A black developer was prepared by adding 27.0 g of a terpolymer of methyl methacrylate (67%), methacrylic acid (3%) and ethylhexyl acrylate (30%; weight-average molecular weight of 172,000, acid no. is 13), 3.0 g of Sterling ® NS Black pigment (Cabot Corporation, Boston, MA), and 120.0 g of Isopar ®-L (Exxon Corporation) to a Union Process 01 Attritor (Union Process Company, Akron, OH) charged with 0.1875 inch (4.76 mm) diameter carbon steel balls. The mixture was milled at approximately 100° C. for 1 hour then 50.0 g of Isopar ®-L were added. The mixture was cooled and milled for at least 4 hours at ambient temperature. The particle size was 10.85 μm. The developer was diluted and charged as follows: 100.0 g of 1.5% solids was charged with 2.4 g of 10% Emphos ® D70-30C (Witco Chemical Corporation, Houston, TX). Image quality was determined as described in Control 4. Results are shown in Table 8 below.

EXAMPLE 11

A black developer was prepared as described in Control 7 except that 0.3 g of nickel acetylacetonate ($Ni(acac)_2$) (Aldrich Chemical Company, Inc., Milwaukee, WI) was dispersed in the resin during processing. Mobility and charge/mass data given in Table 8 below can be correlated to the performance in an imaging apparatus as described in Control 4.

TABLE 8

| Control or Example | Mobility ($m^2/Vsec \times 10^{-10}$) | Toner charge | Transfer Efficiency (%) |
|---|---|---|---|
| C7 | 1.1 | bipolar (positive and negative) | 50 |
| E11 | 1.9 | positive | 90–95 |

We claim:

1. An improved electrostatic liquid developer consisting essentially of (A) a nonpolar liquid having a Kauri-butanol value of less then 30, present in a major amount, (B) thermoplastic resin particles having an average by area particle size of less than 30 μm, (C) a nonpolar liquid soluble ionic or zwitterionic charge director compound, and (D) a β-diketone compound of the general formula:

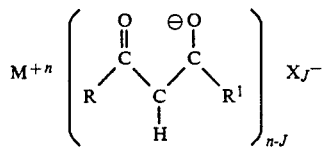

where M is a metal cation;

R and $R^1$ which can be the same or different are alkyl of 1 to 18 carbon atoms, substituted alkyl of 1 to 18 carbon atoms, aryl of 6 to 30 carbon atoms, or substituted aryl of 6 to 30 carbon atoms;

n is the valency of the metal;

J is 0 to n−1; and $X^-$ is OH, Cl, F, sulphate, nitrate, chlorate, phosphate, acetate, alkyl carboxylate of 1 to 18 carbon atoms, or aryl carboxylate of 6 to 30 carbon atoms.

2. An electrostatic liquid developer according to claim 1 wherein the metal salt of β-diketone is calcium acetylacetonate.

3. An electrostatic liquid developer according to claim 1 wherein the metal salt of β-diketone is aluminium octadecanoylacetonate.

4. An electrostatic liquid developer according to claim 1 wherein the metal salt of β-diketone is aluminium benzoylacetonate.

5. An electrostatic liquid developer according to claim 1 wherein the metal salt of β-diketone is nickel acetylacetonate.

6. An electrostatic liquid developer according to claim 1 wherein the metal salt of β-diketone is chromium acetylacetonate.

7. An electrostatic liquid developer according to claim 1 wherein the metal salt of β-diketone is aluminum acetylacetonate.

8. An electrostatic liquid developer according to claim 1 wherein component (A) is present in 85 to 99.9% by weight, based on the total weight of liquid developer, the total weight of developer solids is 0.1 to 15.0% by weight, and component (C) is present in an amount of 0.25 to 1500 mg/g developer solids.

9. An electrostatic liquid developer according to claim 8 wherein the metal salt of β-diketone is present in 0.1 to 40% by weight based on the total weight of the developer solids.

10. An electrostatic liquid developer according to claim 1 containing up to about 60% by weight of a colorant based on the total weight of developer solids.

11. An electrostatic liquid developer according to claim 10 wherein the colorant is a pigment.

12. An electrostatic liquid developer according to claim 10 wherein the colorant is a dye.

13. An electrostatic liquid developer according to claim 1 wherein a fine particle size inorganic oxide is present.

14. An electrostatic liquid developer according to claim 1 wherein an additional compound is present which is an adjuvant selected from the group consisting of polyhydroxy compound, aminoalcohol, polybutylene succinimide, metallic soap, and an aromatic hydrocarbon.

15. An electrostatic liquid developer according to claim 10 wherein an additional compound is present which is an adjuvant selected from the group consisting of polyhydroxy compound, aminoalcohol, polybutylene succinimide, metallic soap, and an aromatic hydrocarbon.

16. An electrostatic liquid developer according to claim 14 wherein a polyhydroxy compound is present.

17. An electrostatic liquid developer according to claim 14 wherein an aminoalcohol compound is present.

18. An electrostatic liquid developer according to claim 14 wherein a polybutylene succinimide compound is present.

19. An electrostatic liquid developer according to claim 14 wherein a metallic soap compound is present dispersed in the resin particles.

20. An electrostatic liquid developer according to claim 14 wherein an aromatic hydrocarbon compound is present.

21. An electrostatic liquid developer according to claim 17 wherein the aminoalcohol compound is triisopropanolamine.

22. An electrostatic liquid developer according to claim 1 wherein the thermoplastic resin is a copolymer of ethylene and an α,β-ethylenically unsaturated acid selected from the group consisting of acrylic acid and methacrylic acid.

23. An electrostatic liquid developer according to claim 1 wherein the thermoplastic resin is polystyrene.

24. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

25. An electrostatic liquid developer according to claim 10 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

26. An electrostatic liquid developer according to claim 24 wherein the thermoplastic resin is a copolymer of ethylene (90%)/methacrylic acid (10%) having a melt index at 190° C. of 500.

27. An electrostatic liquid developer according to claim 1 wherein the particles have an average by area particle size of less than 5 μm.

28. An electrostatic liquid toner according to claim 1 wherein component (C) is an oil-soluble petroleum sulfonate.

29. An electrostatic liquid toner according to claim 1 wherein component (C) is an anionic glyceride.

30. A process for preparing electrostatic liquid developer for electrostatic imaging comprising (A) dispersing at an elevated temperature in a vessel a thermoplastic resin and a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media;

(D) adding to the dispersion a nonpolar liquid soluble ionic or zwitterionic charge director compound; and (E) adding during any of steps (A), (B), (C) or (D) a metal salt of the general formula:

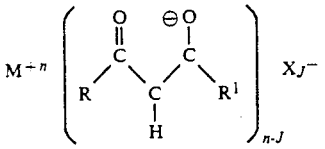

where M is a metal cation;

R and $R^1$ which can be the same or different are alkyl of 1 to 18 carbon atoms, substituted alkyl of 1 to 18 carbon atoms, aryl of 6 to 30 carbon atoms, or substituted aryl of 6 to 30 carbon atoms;

n is the valency of the metal;

J is 0 to n−1; and $X^-$ is OH, Cl, F, sulphate, nitrate, chlorate, phosphate, acetate, alkyl carboxylate of 1 to 18 carbon atoms, or aryl carboxylate of 6 to 30 carbon atoms.

31. A process according to claim 30 wherein the metal salt of β-diketone is calcium acetylacetonate.

32. A process according to claim 30 wherein the metal salt of β-diketone is aluminum acetylacetonate.

33. A process according to claim 30 wherein the metal salt of β-diketone is aluminium octadecanoylacetonate.

34. A process according to claim 30 wherein the metal salt of β-diketone is aluminium benzoylacetonate.

35. A process according to claim 30 wherein the metal salt of β-diketone is nickel acetylacetoneate.

36. A process according to claim 30 wherein the metal salt of β-diketone is chromium acetylacetonate.

37. A process according to claim 30 wherein there is present in the vessel up to 100% by weight of a polar liquid having a Kauri-butanol value of at least 30, the percentage being based on the total weight of the developer liquid.

38. A process according to claim 30 wherein the particulate media are selected from the group consisting of stainless steel, carbon steel, ceramic, alumina, zirconia, silica, and sillimanite.

39. A process according to claim 30 wherein the thermoplastic resin is a copolymer of ethylene and an α,β-ethylenically unsaturated acid selected from the group consisting of acrylic acid and methacrylic acid.

40. A process according to claim 30 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

41. A process according to claim 40 wherein the thermoplastic resin is a copolymer of ethylene (90%)/methacrylic acid (10%) having a melt index at 190° C. of 500.

42. A process according to claim 30 wherein the charge director compound is an oil-soluble petroleum sulfonate.

43. A process according to claim 30 wherein the charge director is an anionic glyceride.

44. A process according to claim 30 wherein the additional nonpolar liquid, polar liquid, or combinations thereof is present to reduce the concentration of toner particles to between 0.1 to 15 percent by weight with respect to the liquid.

45. A process according to claim 44 wherein the concentration of toner particles is reduced by additional nonpolar liquid.

46. A process according to claim 30 wherein cooling the dispersion is accomplished while grinding by means of particulate media to prevent the formation of a gel or solid mass with or without the presence of additional liquid.

47. A process according to claim 30 wherein cooling the dispersion is accomplished without stirring to form a gel or solid mass, followed by shredding the gel or solid mass and grinding by means of particulate media with or without the presence of additional liquid.

48. A process according to claim 30 wherein cooling the dispersion is accomplished with stirring to form a viscous mixture and grinding by means of particulate media with or without the presence of additional liquid.

49. A process according to claim 30 wherein an adjuvant compound selected from the group consisting of polyhydroxy compound, aminoalcohol, polybutylene succinimide, metallic soap, and aromatic hydrocarbon is added during the dispersing step (A).

50. A process according to claim 49 wherein the adjuvant compound is an aminoalcohol.

51. A process according to claim 50 wherein the aminoalcohol is triisopropanolamine.

52. A process according to claim 44 wherein an adjuvant compound selected from the group consisting of polyhydroxy compound, aminoalcohol, polybutylene succinimide, metallic soap, and an aromatic hydrocarbon is added to the liquid developer.

53. A process according to claim 52 wherein the adjuvant compound is a polyhydroxy compound.

54. A process according to claim 53 wherein the polyhydroxy compound is ethylene glycol.

55. A process according to claim 52 wherein the adjuvant compound is a metallic soap dispersed in the resin particles.

56. A process according to claim 55 wherein the adjuvant compound is aluminium tristearate.

57. A process for preparing electrostatic liquid developer comprising (A) dispersing a colorant in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, (E) adding additional nonpolar liquid, polar liquid or combinations thereof to reduce the concentration of toner particles to between 0.1 to 15.0 percent by weight with respect to the liquid;

(F) adding to the dispersion a liquid soluble ionic or zwitterionic charge director compound, and (G) adding during any of steps (A), (B), (C), (D), (E), or (F) a metal salt of a β-diketone according to claim 1.

58. A process for preparing electrostatic liquid developer comprising (A) dispersing a colorant in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, and (F) adding additional nonpolar liquid, polar liquid or combinations thereof to reduce the concentration of toner particles to between 0.1 to 15.0 percent by weight with respect to the liquid;

(G) adding to the dispersion a liquid soluble ionic or zwitterionic charge director compound, and (H) adding during any of steps (A), (B), (C), (D), (E), (F) or (G) a metal salt of a β-diketone according to claim 1.

* * * * *